United States Patent [19]

Kipke

[11] Patent Number: 4,625,136

[45] Date of Patent: Nov. 25, 1986

[54] BRUSH ASSEMBLY FOR ELECTRICAL MACHINE

[75] Inventor: Winfried Kipke, Belm, Fed. Rep. of Germany

[73] Assignee: Max Frost KG Maschinen-und Apparatebau, Bohmte, Fed. Rep. of Germany

[21] Appl. No.: 685,316

[22] Filed: Dec. 24, 1984

[30] Foreign Application Priority Data

Dec. 23, 1983 [DE] Fed. Rep. of Germany ..... 3346595

[51] Int. Cl.[4] ..... H01R 39/38; H01R 39/40

[52] U.S. Cl. ..... 310/239; 310/242; 310/245; 310/246

[58] Field of Search ..... 310/239, 240, 241, 242, 310/245, 246, 248

[56] References Cited

U.S. PATENT DOCUMENTS

| | | | |
|---|---|---|---|
| 2,881,339 | 4/1959 | Fisher | 310/246 |
| 3,158,772 | 11/1964 | Krellner | 310/246 |
| 3,436,577 | 4/1969 | DeWolf | 310/242 X |
| 3,816,783 | 6/1974 | Nakamura et al. | 310/246 |
| 3,902,088 | 8/1975 | Guglielmo | 310/246 |
| 3,983,432 | 9/1976 | Rankin | 310/242 |

*Primary Examiner*—Patrick R. Salce
*Assistant Examiner*—Marc S. Hoff
*Attorney, Agent, or Firm*—Michael J. Striker

[57] ABSTRACT

A brush assembly for an electrical machine has a holder having a pair of generally parallel side walls having confronting inner faces, a guide wall extending along and between the inner faces and in turn having an inner face defining with the faces of the side walls a passage extending in a longitudinal direction and having a longitudinally forwardly open front end, and an angled surface adjacent the front end. The brush in the passage has a longitudinal guide face longitudinally slidable on the inner face of the guide wall but out of contact with the side walls, an opposite longitudinal face turned away from the guide wall, and axially opposite front and rear ends. A coil spring has a coiled part engaged between the angled surface and the opposite brush face at the front end of the brush to transversely urge the brush against the inner face of the guide wall and a free end extending longitudinally back along the opposite face longitudinally past the rear end of the brush. A pusher block is carried on the free end in the passage longitudinally behind and engaging the rear end of the brush. The rear end of the brush and the pusher block have flatly engaging pusher faces extending obliquely of the direction. Thus as the spring seeks to coil up it pushes the brush longitudinally forward in the passage and transmits transverse force between the pusher block and the brush by means of the oblique pusher faces.

11 Claims, 4 Drawing Figures

BRUSH ASSEMBLY FOR ELECTRICAL MACHINE

FIELD OF THE INVENTION

The present invention relates to a brush assembly for an electrical machine such as a motor or generator. More particularly this invention concerns a holder for such a brush.

BACKGROUND OF THE INVENTION

In an electrical machine such as a motor or generator stationary brushes radially engage the commutator rings of the rotor to transmit electricity via these rings to the windings of the rotor in a motor or to pick up the electricity generated in the rotor's windings in a generator. The brush is normally a mainly graphite block that is received in a longitudinal passage of a holder. The longitudinal direction of the passage is aligned radially of the rotor or perpendicular to the surface that the brush is to make electrical contact with, and the brush is longitudinally slidable along the passage. A spring is braced between the holder and the brush to move it longitudinally along the passage toward the front end thereof, so that as the front end of the brush is worn off the brush is advanced to compensate.

In an arrangement described in U.S. Pat. No. 3,902,088 the brush holder has a pair of generally parallel side walls having confronting inner faces, a top guide wall extending along and between the inner faces and in turn having an inner face, and a bottom wall in turn having an inner face defining the passage with the other inner faces. In addition this housing has an angled surface adjacent the front end. The brush is snugly received in the passage, in continuous sliding contact with the inner faces of the side and guide walls and has a bottom face spaced from the bottom holder wall. A coil spring has a coiled part engaged between the angled surface and the bottom brush face at the front end of the brush to transversely urge the brush against the inner face of the guide wall and a free end extending longitudinally back along the bottom face and secured near the rear end of the brush thereto. Thus the coiled part pushes the front end of the brush, which is that portion of the brush at the front end of the passage, upward against the guide wall and the free end pulls the whole brush axially forward.

In such an arrangement the concentration of all the laterally effective spring forces at the front end of the brush leads to premature wear in this region. Furthermore the brush and holder must be very accurately made so that the brush fits snugly between the side holder walls while still being able to slide longitudinally in this holder. This tight fit keeps the brush centered and in theory avoids canting or twisting of the brush in the holder. On the other hand such a tight fit makes the system particularly susceptible to jamming when carbon dust clogs between the brush and holder. It is fairly common for the brush to stick or become wedged in place, in particular when subjected to substantial vibration or jarring.

OBJECTS OF THE INVENTION

It is therefore an object of the present invention to provide an improved brush assembly for an electric machine.

Another object is the provision of such a brush assembly for an electric machine which overcomes the above-given disadvantages, that is which is of simple construction but which is not likely to jam.

SUMMARY OF THE INVENTION

A brush assembly for an electrical machine according to the invention has a holder having a pair of generally parallel side walls having confronting inner faces, a guide wall extending along and between the inner faces and in turn having an inner face defining with the faces of the side walls a passage extending in a longitudinal direction and having a longitudinally forwardly open front end, and an angled surface adjacent the front end. The brush in the passage has a longitudinal guide face longitudinally slidable on the inner face of the guide wall but out of contact with the side walls, an opposite longitudinal face turned away from the guide wall, and axially opposite front and rear ends. A coil spring has a coiled part engaged between the angled surface and the opposite brush face at the front end of the brush to transversely urge the brush against the inner face of the guide wall and a free end extending longitudinally back along the opposite face longitudinally past the rear end of the brush. A pusher block is carried on the free end in the passage longitudinally behind and engaging the rear end of the brush. The rear end of the brush and the pusher block have flatly engaging pusher faces extending obliquely of the direction. Thus as the spring seeks to coil up it pushes the brush longitudinally forward in the passage and transmits transverse force between the pusher block and the brush by means of the oblique pusher faces.

The advantage of this arrangement is that the brush is urged laterally along its full length against the guide, thereby eliminating localized wear. In addition the play between the brush and the holder means that these two elements need not be meticulously crafted to close tolerances. Thus wedging or jamming of the brush in the holder is virtually impossible.

According to another feature of this invention the inner face of the guide wall has two flat surface portions that extend at an angle to each other. The guide face is complementarily formed with two flat surface portions flatly engaging the surface portions of the inner face of the guide wall. This makes the brush self-centering when the assembly is symmetrical about a plane midway between and parallel to the inner faces of the two side walls. In addition good flat contact is provided for conducting electricity from the holder to the brush or vice versa, eliminating the need for a special copper cable connected to the brush and reducing its effective length and weakening it. Using the holder as the connection greatly reduces the chances of the assembly burning out if short circuited, and makes it simple to mount the holder right on a conducting buss. Only these two guide-surface portions need be carefully machined so that manufacturing costs of the assembly according to the invention are reduced, and they could be curved rather than perfectly planar if desired.

In accordance with another feature of this invention the inner face of the guide wall has between the two surface portions a connecting surface portion perpendicular to the symmetry plane and the guide face similarly has between its two surface portions a respective connecting surface that is parallel to but out of contact with the connecting surface of the guide wall. Thus clogging of the interface with carbon dust and the resultant jamming are therefore eliminated. Similarly, the brush has side faces spaced transversely inward from the inner faces of the side walls of the holder.

The holder of this invention has a clip that forms or is itself formed with a longitudinal guide extending along the opposite face of the brush and longitudinally slidably receiving the pusher block. A low-friction synthetic-resin coating can be provided between the spring and the angled surface. In addition the coil spring can be mounted by a sleeve on a shaft in its coiled part and itself riding on the angled surface and a high-friction coating can be provided between the spring and the opposite face of the brush.

DESCRIPTION OF THE DRAWING

The above and other features and advantages will become more readily apparent from the following, it being understood that any feature described with reference to one embodiment of the invention can be used where possible with any other embodiment. In the accompanying drawing.

SPECIFIC DESCRIPTION

Figure 2:
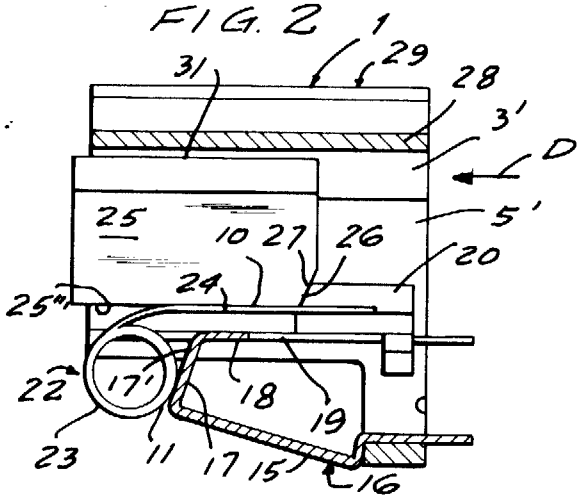
FIG. 2 is a longitudinal section taken along line II—II of FIG. 1.
Figure 1:
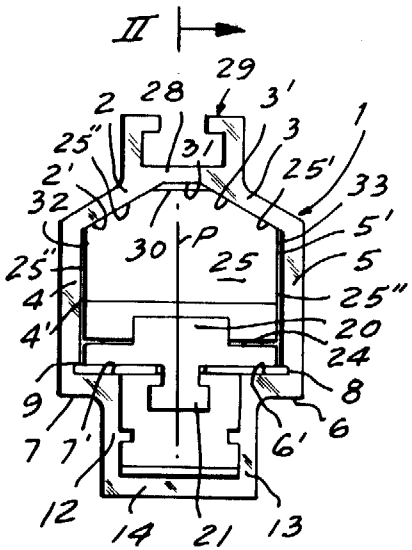
FIG. 1 is an end view from the rear of a brush assembly according to this invention.

As seen in FIGS. 1 and 2 a brush assembly according to this invention basically comprises a holder 1, a brush 25, a coil spring 22, a pusher block 20, and a clip 16.

The holder 1 is unitarily formed and has a top guide wall 2, 3, 28 formed by two angled portions 2 and 3 having respective inner faces 2' and 3' and a bridge portion 28 extending between them and perpendicular to a symmetry plane P of the assembly. Two parallel side walls 4 and 5 having respective inner faces 4' and 5' extend down from the portions 2 and 3 (It being understood that the reference to the vertical is purely for clarity of description and in no way intended to limit the actual position the invention can be used in.) with the faces 4' and 5' parallel to the plane P. A pair of bottom-wall portions 6 and 7 extend inward toward each other from the lower edges of the side walls 4 and 5 and have respective upper surfaces 6' and 7' perpendicular to the surfaces 4' and 5'. An inwardly open and longitudinally extending groove 8 is formed at the intersection of the faces 5' and 6' and another such groove 9 is formed at the intersection of the faces 4' and 7', confronting the groove 8. The top of the holder 1 is formed with a guide slot 29 that allows it to be mounted easily in place in the electric machine it is to serve.

The brush 25 has a pair of upper surface portions 25' that respectively flatly engage the surfaces 2' and 3' and that are symmetrical to the plane P. Between these surface portions 25' the brush has a central portion 30 that confronts but is spaced from the surface 31 of the portion 28. The brush 25 also has side surfaces 25" that are parallel to the surfaces 4' and 5', but separated therefrom by gaps 32 and 33. Thus the brush 25, if urged upward as described below, will self center in the holder 1.

A U-shaped brace 12, 13, 14 has two legs 12 and 13 extending down from the bottom-wall portions 6 and 7 and a bight portion 14 bridging them. The clip 16 has one leg braced against this bight 14, an intermediate portion 17 forming an angled surface 17', and another leg 18 extending back in the grooves 8 and 9 and having a central longitudinally extending and backwardly open guide slot 19. This clip 16 is made of spring steel and allows relatively easy replacement of the brush 25.

The coil spring 22 has a coiled part 23 which rides on the angled surface 17', which has a coating 11 of polytetrafluoroethylene or a similar material with a low coefficient of sliding friction so that this coiled part 23 can move easily on the angled surface 17'. This spring 22 also has a free end 24 which extends back between a bottom surface 25''' of the brush 25 and the leg 18 of the clip 6. This face 25''' carries a sticky coating 10 that inhibits longitudinal sliding of the brush 25 on the spring 22. In addition the extreme end of the free part 24 is secured to a pusher block 20 having a T-section guide 21 projecting through the guide slot 19. This block 20 and the rear end of the brush 25 have complementary and flatly engaging oblique surfaces 26 and 27.

Thus the coiled part 23 of the spring 22 will urge the front part of the brush 25 up against the surfaces 25'. In addition in trying to coil itself up, the end 24 will seek to move longitudinally forward (to the left in FIG. 2) and will longitudinally forwardly advance the brush 25 as its front end is worn off. The oblique surfaces 17', which are not perpendicular to the direction D, have a camming action that similarly urges the rear end of the brush 25 up and into good contact with the surfaces 2' and 3'. As a result wear will be spread uniformly along the top of the brush 25.

Figure 3:
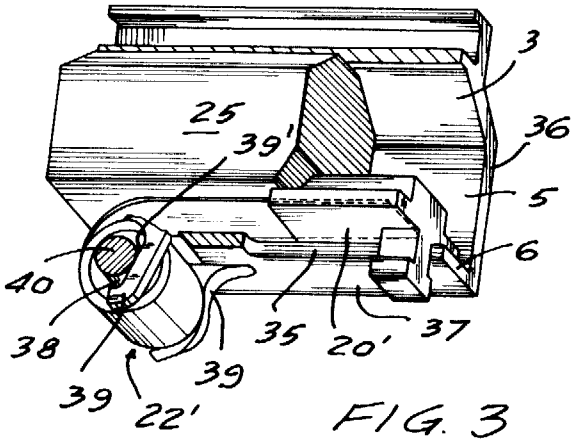
FIG. 3 is a perspective view of another brush assembly in accordance with the invention.

The arrangement of FIG. 3 is similar to that of FIG. 1, but dispenses with the clip 16. To this end the holder has a floor 37 bridging its side walls and formed with a guide slot 35 serving like the slot 19 of FIGS. 1 and 2. In addition this floor 37 has a pair of tabs 39 forming angled surfaces 39' and engaging a shaft 38 of a coil spring 22'. This shaft 38 is centered on an axis 40 and is normally urged upward by the inclined front faces 39' of the tabs 39.

Figure 4:
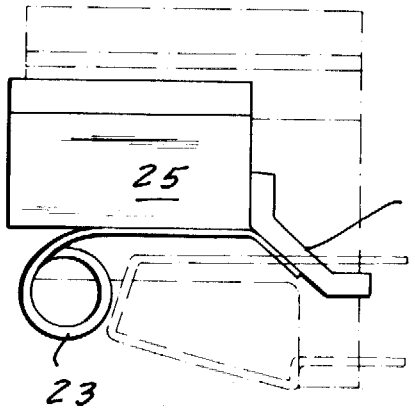
FIG. 4 is a mainly schematic view like FIG. 2 of another brush assembly in accordance with the invention.

In the arrangement of FIG. 4 an angled pusher 20 is used in an arrangement wherein the spring is very strongly tensioned and the transverse force is on the other hand small.

I claim:

1. A brush assembly for an electrical machine, the assembly comprising:

a holder having a pair of generally parallel side walls having confronting inner faces, a guide wall extending along and between the inner faces and in turn having an inner face defining with the faces of the side walls a passage extending in a longitudinal direction and having a longitudinally forwardly open front end, and an angled surface adjacent the front end;

a brush in the passage having a longitudinal guide face longitudinally slidable on the inner face of the guide wall but out of contact with the side walls, an opposite longitudinal face turned away from the guide wall, and axially opposite front and rear ends;

a coil spring having a coiled part engaged between the angled surface and the opposite brush face at the front end of the brush to transversely urge the brush against the inner face of the guide wall and a free end extending longitudinally back along the opposite face longitudinally past the rear end of the brush; and a pusher block carried on the free end in the passage longitudinally behind and engaging the rear end of the brush, the rear end of the brush and the pusher block having flatly engaging pusher faces extending obliquely of the direction, forming with the direction a forwardly open obtuse angle, and defining a plane transverse to the direction, whereby as the spring seeks to coil up it pushes the brush longitudinally forward in the passage and transmits transverse force between the pusher block and the brush by means of the oblique pusher faces.

2. The brush assembly defined in claim 1 wherein the inner face of the guide wall is comprised of two flat surface portions that extend at an angle to each other, the guide face being complementarily formed with two flat surface portions flatly engaging the surface portions of the inner face of the guide wall.

3. The brush assembly defined in claim 2 wherein the inner face of the guide wall has between the two surface portions a connecting surface portion and the guide face similarly has between its two surface portions a respective connecting surface that is out of contact with the connecting surface of the guide wall.

4. The brush assembly defined in claim 1 wherein the brush has side faces spaced transversely inward from the inner faces of the side walls of the holder.

5. The brush assembly defined in claim 1 wherein the holder is provided with a longitudinal guide extending along the opposite face of the brush and longitudinally slidably receiving the pusher block.

6. The brush assembly defined in claim 1, further comprising a low-friction synthetic-resin coating between the spring and the angled surface.

7. The brush assembly defined in claim 1 wherein the coil spring has a shaft in and fixed to its coiled part and rides via this shaft on the angled surface.

8. The brush assembly defined in claim 1, further comprising a high-friction coating between the spring and the opposite face of the brush.

9. The brush assembly defined in claim 1 wherein the holder has a floor wall bridging the side walls, the free end of the spring lying between the floor wall and the opposite longitudinal face of the brush, the floor wall being formed with a guide slot longitudinally slidably receiving the pusher block.

10. The brush assembly defined in claim 9 wherein the angled surface is formed by the floor wall.

11. The brush assembly defined in claim 1 wherein the angled surface extends obliquely of the direction, forms with the direction a forwardly open obtuse angle, and defines a plane transverse to the direction.

* * * * *